US009017605B2

(12) United States Patent
Nazmy et al.

(10) Patent No.: US 9,017,605 B2
(45) **Date of Patent: *Apr. 28, 2015**

(54) NICKEL-BASED SUPERALLOY

(75) Inventors: Mohamed Youssef Nazmy, Fislisbach (CH); Andreas Kuenzler, Baden (CH); Claus Paul Gerdes, Ruetihof (CH)

(73) Assignee: Alstom Technology Ltd., Baden (CH)

( * ) Notice: Subject to any disclaimer, the term of this patent is extended or adjusted under 35 U.S.C. 154(b) by 669 days.

This patent is subject to a terminal disclaimer.

(21) Appl. No.: 13/332,821

(22) Filed: Dec. 21, 2011

(65) Prior Publication Data

US 2012/0128527 A1 May 24, 2012

(30) Foreign Application Priority Data

Jul. 9, 2009 (CH) ..... 1069/09

(51) Int. Cl.
*C22C 19/05* (2006.01)

(52) U.S. Cl.
CPC ..... *C22C 19/057* (2013.01)

(58) Field of Classification Search
CPC ..... C22C 19/057
USPC ..... 420/448
See application file for complete search history.

(56) References Cited

U.S. PATENT DOCUMENTS

| | | | | |
|---|---|---|---|---|
| 3,526,499 | A | 9/1970 | Quigg et al. | |
| 5,270,123 | A | 12/1993 | Walston et al. | |
| 6,190,471 | B1 | 2/2001 | Darolia et al. | |
| 6,740,292 | B2 * | 5/2004 | Arrell et al. | 420/448 |
| 6,905,559 | B2 | 6/2005 | O'Hara et al. | |
| 2002/0062886 | A1 | 5/2002 | Hino et al. | |
| 2004/0005238 | A1 | 1/2004 | Arrell et al. | |
| 2011/0194972 | A1 | 8/2011 | Nazmy et al. | |

FOREIGN PATENT DOCUMENTS

| | | | |
|---|---|---|---|
| EP | 0155827 | | 9/1985 |
| EP | 1 319 729 | A1 | 6/2003 |
| EP | 1359231 | | 11/2003 |
| EP | 1 184 473 | B1 | 1/2005 |
| EP | 1900839 | | 3/2008 |
| JP | 2001-294959 | A | 10/2001 |
| JP | 2004-027361 | A | 1/2004 |
| JP | 2011-162878 | A | 8/2011 |
| RU | 2 088 685 | C1 | 8/1997 |
| RU | 2 186 144 | C1 | 7/2002 |
| WO | 2007/119404 | A1 | 10/2007 |
| WO | WO2011-003804 | | 1/2011 |

OTHER PUBLICATIONS

Caron, Pierre, and Tasadduq Khan. "Evolution of Ni-based superalloys for single crystal gas turbine blade applications." Aerospace Science and Technology 3.8 (1999): 513-523.*

Office Action issued on Apr. 21, 2014, by the Russian Patent Office in corresponding Russian Patent Application No. 2012104486. (12 pages).

Office Action issued on Feb. 20, 2014 by the European Patent Office in corresponding European Patent Application No. 10726136.4-1362. (11 pages).

Office Action (Notification of Reasons for Refusal) issued on Apr. 7, 2014, by the Japan Patent Office in corresponding Japanese Patent Application No. 2012-518908, and an English Translation of the Office Action. (4 pages).

Search Report for Swiss Patent App. No. 1069/2009 (Nov. 4, 2009).

* cited by examiner

*Primary Examiner* — Jessee Roe

(74) *Attorney, Agent, or Firm* — Buchanan Ingersoll & Rooney PC

(57) ABSTRACT

A nickel-base superalloy is characterized by the following chemical composition (details in % by weight): 7.7-8.3 Cr, 5.0-5.25 Co, 2.0-2.1 Mo, 7.8-8.3 W, 5.8-6.1 Ta, 4.9-5.1 Al, 1.0-1.5 Ti, 1.0-2.0 Re, 0.11-0.15 Si, 0.1-0.7 Hf, 0-0.5 Nb, 0.02-0.17 C, 50-400 ppm B, remainder Ni and production-related impurities. The alloy is distinguished by a very high resistance to oxidation, resistance to corrosion and good creep properties at high temperatures.

13 Claims, 3 Drawing Sheets

NICKEL-BASED SUPERALLOY

This application is a Continuation of, and claims priority under 35 U.S.C. §120 to, International Application No. PCT/EP2010/059368, filed 1 Jul. 2010, and claims priority therethrough under 35 U.S.C. §§119, 365 to Swiss Application No. 01069/09, filed 9 Jul. 2009, the entireties of which are incorporated by reference herein.

BACKGROUND

1. Field of Endeavor

The invention deals with the field of materials science. It relates to a nickel-base superalloy, in particular for the production of single-crystal components (SX alloy) or components with a directionally solidified microstructure (DS alloy), such as for example blades or vanes for gas turbines, but also for conventionally cast components.

2. Brief Description of the Related Art

Nickel-base superalloys of the aforementioned type are known. Single-crystal components made from these alloys have a very good material strength at high temperatures. This allows, for example, the intake temperature of gas turbines to be increased, with the result that the efficiency of the gas turbine rises.

Nickel-base superalloys for single-crystal components, as are known from U.S. Pat. No. 4,643,782, EP 0 208 645 and U.S. Pat. No. 5,270,123, for this purpose contain alloying elements which strengthen the solid solution, for example Re, W, Mo, Co, Cr, and elements which form γ' phases, for example Al, Ta and Ti. The level of high-melting alloying elements (W, Mo, Re) in the basic matrix (austenitic γ phase) increases continuously as the temperature of load on the alloy increases. For example, standard nickel-base superalloys for single crystals contain 6-8% W, about 3-6% Re and up to 2% Mo (in % by weight). The alloys disclosed in the abovementioned documents have a high creep strength, good LCF (low cycle fatigue) and HCF (high cycle fatigue) properties and a high resistance to oxidation.

These known alloys were developed for aircraft turbines and were therefore optimized for short-term and medium-term use, i.e., the load time was designed for up to 20 000 hours. By contrast, industrial gas turbine components have to be designed for a load time of up to 75 000 hours, i.e., for long-term loading.

By way of example, after a load time of 300 hours, the alloy CMSX-4, which is known from U.S. Pat. No. 4,643,782, when it was tested for use in a gas turbine at a temperature of over 1000° C., underwent considerable coarsening of the γ' phase, which disadvantageously leads to an increase in the creep rate of the alloy.

On account of the long-term loading of gas turbines, it is therefore necessary to improve the resistance of the known alloys to oxidation at very high temperatures.

It is known from GB 2 234 521 A that enriching nickel-base superalloys with boron or carbon during a directional solidification produces microstructures which have an equiaxed or prismatic grain structure. Carbon and boron strengthen the grain boundaries, since C and B cause the precipitation of carbides and borides at the grain boundaries, and these compounds are stable at high temperatures. Moreover, the presence of these elements in and along the grain boundaries delays the diffusion process, which is a primary cause of the grain boundary weakness. It is therefore possible to increase the misorientations (usually 6°) to 10° to 12° yet still achieve good properties of the material at high temperatures.

EP 1 359 231 B1 discloses a nickel-base superalloy which has improved casting properties and a higher resistance to oxidation than known nickel-base superalloys and is additionally suitable, for example, particularly for large gas turbine single-crystal components having a length of >80 mm. The nickel-base superalloy disclosed therein is characterized by the following chemical composition (details in % by weight): 7.7-8.3 Cr, 5.0-5.25 Co, 2.0-2.1 Mo, 7.8-8.3 W, 5.8-6.1 Ta, 4.9-5.1 Al, 1.3-1.4 Ti, 0.11-0.15 Si, 0.11-0.15 Hf, 200-750 ppm C, 50-400 ppm B, remainder nickel and production-related impurities. A preferred alloy having the composition (in % by weight): 7.7-8.3 Cr, 5.0-5.25 Co, 2.0-2.1 Mo, 7.8-8.3 W, 5.8-6.1 Ta, 4.9-5.1 Al, 1.3-1.4 Ti, 0.11-0.15 Si, 0.11-0.15 Hf, 200-300 ppm C, 50-100 ppm B, remainder nickel and production-related impurities, is outstandingly suitable for producing large single-crystal components, for example blades or vanes for gas turbines.

SUMMARY

One of numerous aspects of the invention includes an alloy which, compared to the alloys known from the prior art, can be distinguished by a further optimization in properties with respect to the use as a gas turbine component. Another of these aspects includes a nickel-base superalloy which has a high resistance to oxidation and, at the same time, a high resistance to corrosion (given a differing fuel quality) and is additionally, advantageously less expensive compared to known nickel-base superalloys of this type.

In another aspect, a nickel-base superalloy is characterized by the following chemical composition (in % by weight):

7.7-8.3 Cr
5.0-5.25 Co
2.0-2.1 Mo
7.8-8.3 W
5.8-6.1 Ta
4.9-5.1 Al
1.0-1.5 Ti
1.0-2.0 Re
0-0.5 Nb
0.11-0.15 Si
0.1-0.7 Hf
0.02-0.17 C
50-400 ppm B remainder nickel and production-related impurities.

Advantages of the alloys embodying principles of the present invention include that the alloy has a very high resistance to oxidation and, at the same time, a high resistance to corrosion at high temperatures. This is surprisingly achieved primarily by the relatively small addition of Re.

It is particularly advantageous if the alloy comprises 1.0-1.5% by weight, preferably 1.5% by weight, Re. If the C content is only about 200-300 ppm and the boron content is 50-100 ppm, preferably 90 ppm, alloys embodying principles of the present invention are particularly suitable for producing single-crystal components. The alloy can optionally comprise up to 0.5% by weight, preferably 0.1-0.2% by weight, Nb.

A particularly preferred nickel-base superalloy has the following composition (in % by weight):

8.2 Cr
5.2 Co
2.1 Mo
8.1 W
6.1 Ta
5.0 Al
1.4 Ti 1.5 Re
0-0.2 Nb
0.12 Si
0.1-0.6 Hf
0.095-0.17 C
240-290 ppm B remainder nickel and production-related impurities. This alloy has outstanding properties at high temperatures and is additionally not too expensive on account of the relatively small Re content.

A further advantageous alloy composition is specified hereinbelow (in % by weight):

8.2 Cr
5.2 Co
2.1 Mo
8.1 W
6.1 Ta
5.0 Al
1.4 Ti
1.5 Re
0.1 Nb
0.12 Si
0.1 Hf
200 ppm C
90 ppm B remainder nickel and production-related impurities. This latter alloy is particularly suitable for producing single-crystal components.

BRIEF DESCRIPTION OF THE DRAWINGS

The drawings show an exemplary embodiment of the invention.

DETAILED DESCRIPTION OF EXEMPLARY EMBODIMENTS

The invention is explained in more detail below with reference to an exemplary embodiment and FIGS. 1 to 3.

Nickel-base superalloys having the chemical composition given in table 1 were investigated (in % by weight):

TABLE 1

Chemical composition of the alloys investigated

| | IN738LC (DS) Comparative alloy | KNX1 (CC) | KNX2 (CC) | KNX3 (CC) | KNX4 (CC) | KNX0 (CC) Comparative alloy |
|---|---|---|---|---|---|---|
| Ni | Rem. | Rem. | Rem. | Rem. | Rem. | Rem. |
| Cr | 16 | 8.2 | 8.2 | 8.2 | 8.2 | 8.2 |
| Co | 8.5 | 5.2 | 5.2 | 5.2 | 5.2 | 5.2 |
| Mo | 1.7 | 2.1 | 2.1 | 2.1 | 2.1 | 2.1 |
| W | 2.6 | 8.1 | 8.1 | 8.1 | 8.1 | 8.1 |
| Ta | 1.7 | 6.1 | 6.1 | 6.1 | 6.1 | 6.1 |
| Al | 3.4 | 5 | 5 | 5 | 5 | 5 |
| Ti | 3.4 | 1.4 | 1.4 | 1.4 | 1.4 | 1.4 |
| Hf | — | 0.6 | 0.1 | 0.1 | 0.1 | 0.11 |
| C | — | 0.17 | 0.02 | 0.095 | 0.17 | 0.02 |
| B | 0.01 | 0.029 | 0.009 | 0.024 | 0.029 | 0.009 |
| Si | — | 0.12 | 0.12 | 0.12 | 0.12 | 0.12 |
| Nb | 0.9 | — | 0.1 | — | 0.2 | — |
| Zr | 0.1 | — | — | — | — | — |
| Re | — | 1.5 | 1.5 | 1.5 | 1.5 | — |

The alloy IN738LC is a comparative alloy known from the prior art, KNX0 is likewise a comparative alloy (according to EP 1 359 231 B1), whereas the alloys KNX1 to KNX4 are alloys according to the invention. Here, the addition CC is an abbreviation for "conventionally cast", i.e., conventionally cast alloys having a conventional multi-crystal microstructure, and the addition DS is an abbreviation for "directionally solidified", i.e., for a directionally solidified microstructure.

The alloys according to the invention and the comparative alloy differ, for example, in that the comparative alloy, in contrast to the alloys according to the invention, does not contain C, Si, Hf and Re as alloying elements.

Carbon, primarily also with the boron present, strengthens the grain boundaries, in particular also the small-angle grain boundaries which occur in the <001> direction in SX or DS gas turbine blades or vanes made from nickel-base superalloys, since these elements cause the precipitation of carbides/borides at the grain boundaries, and these compounds are stable at high temperatures. Moreover, the presence of C in and along the grain boundaries reduces the diffusion process, which is a primary cause of the grain boundary weakness. This considerably improves the casting properties of long single-crystal components, for example gas turbine blades or vanes with a length of about 200 to 230 mm.

If nickel-base superalloys with small contents of C and B (max. 200-300 ppm C and 50-100 ppm B) are selected, these can be used as single-crystal alloys; at higher contents of these elements (max 0.17 C, max 400 ppm B)), the components produced from corresponding alloys can also be conventionally cast.

Figure 2:
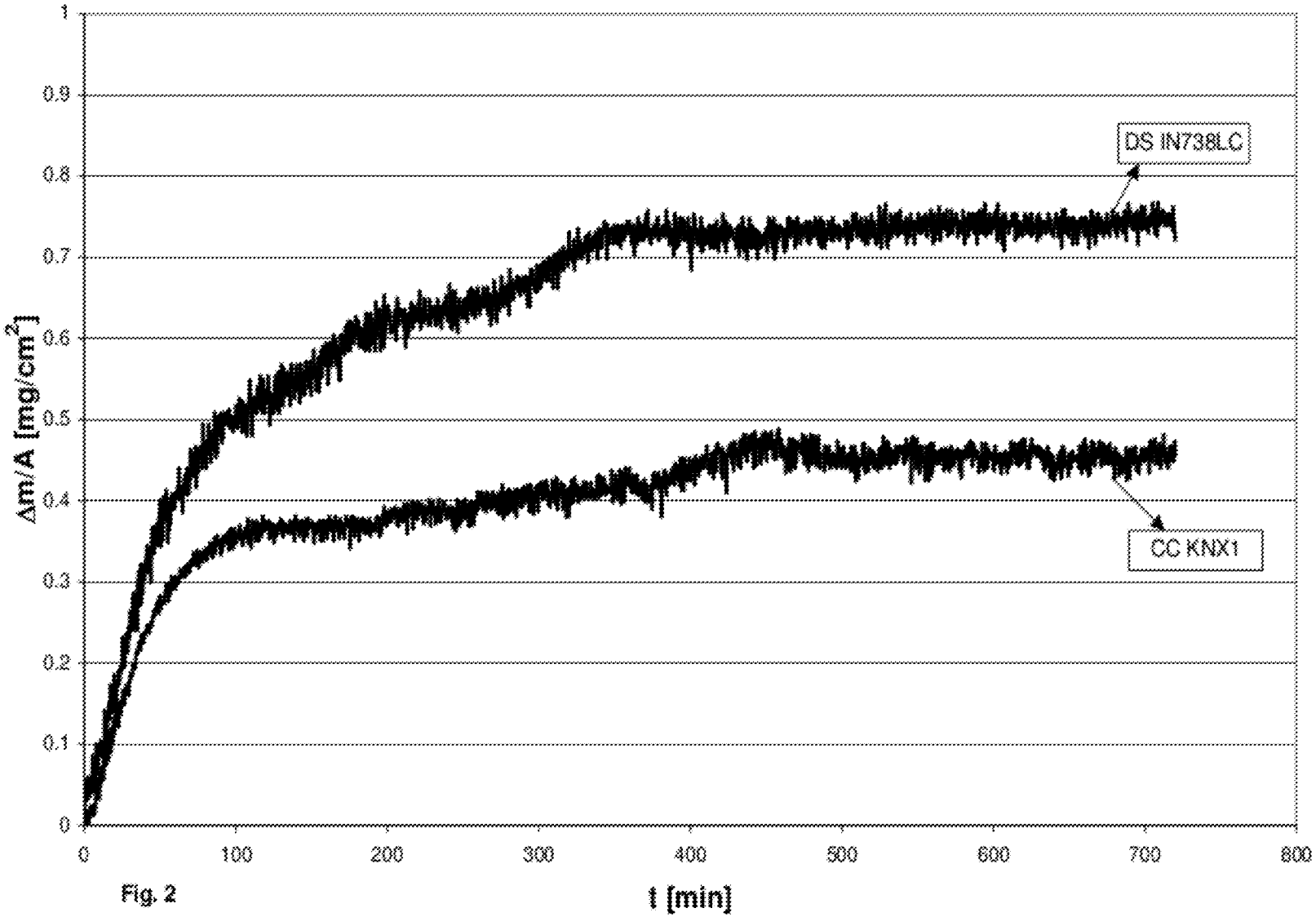
FIG. 2 shows the dependence of the change in specific mass on time at a temperature of 950° C. for the same alloys as in FIG. 1.

The addition of 0.11 to 0.15% by weight Si, in particular in combination with Hf in the given order of magnitude, significantly improves the resistance to oxidation at high temperatures compared to the nickel-base superalloy known from the prior art (see, for example, FIG. 2).

Al and Cr, in the given quantities, also bring about a good resistance to oxidation for the nickel-base superalloys described herein. Moreover, Cr, in conjunction with the Si, also has a positive effect on improving the resistance to corrosion.

Re, W, Mo, Co and Cr are alloying elements which strengthen the solid solution, and Al, Ta and Ti are elements which form γ' phases, which all improve the material strength at high temperatures. Since, in this respect, particularly the content of high-melting alloying elements (W, Mo, Re) in the basic matrix is considered decisive for an increase in the maximum possible temperature of load on the alloy, these alloying elements, primarily the Re, have been added in relatively large quantities to date.

The moderate rhenium content of the nickel-base superalloy according to principles of the present invention, preferably 1.5% by weight, advantageously firstly increases the creep strength of the alloy, and secondly this alloying element does not entail such extremely high costs, as arise for example in the case of the second and third generation nickel-base single-crystal superalloys known from the prior art, which have relatively high rhenium contents (about 3 to 6% by weight Re).

Figure 1:
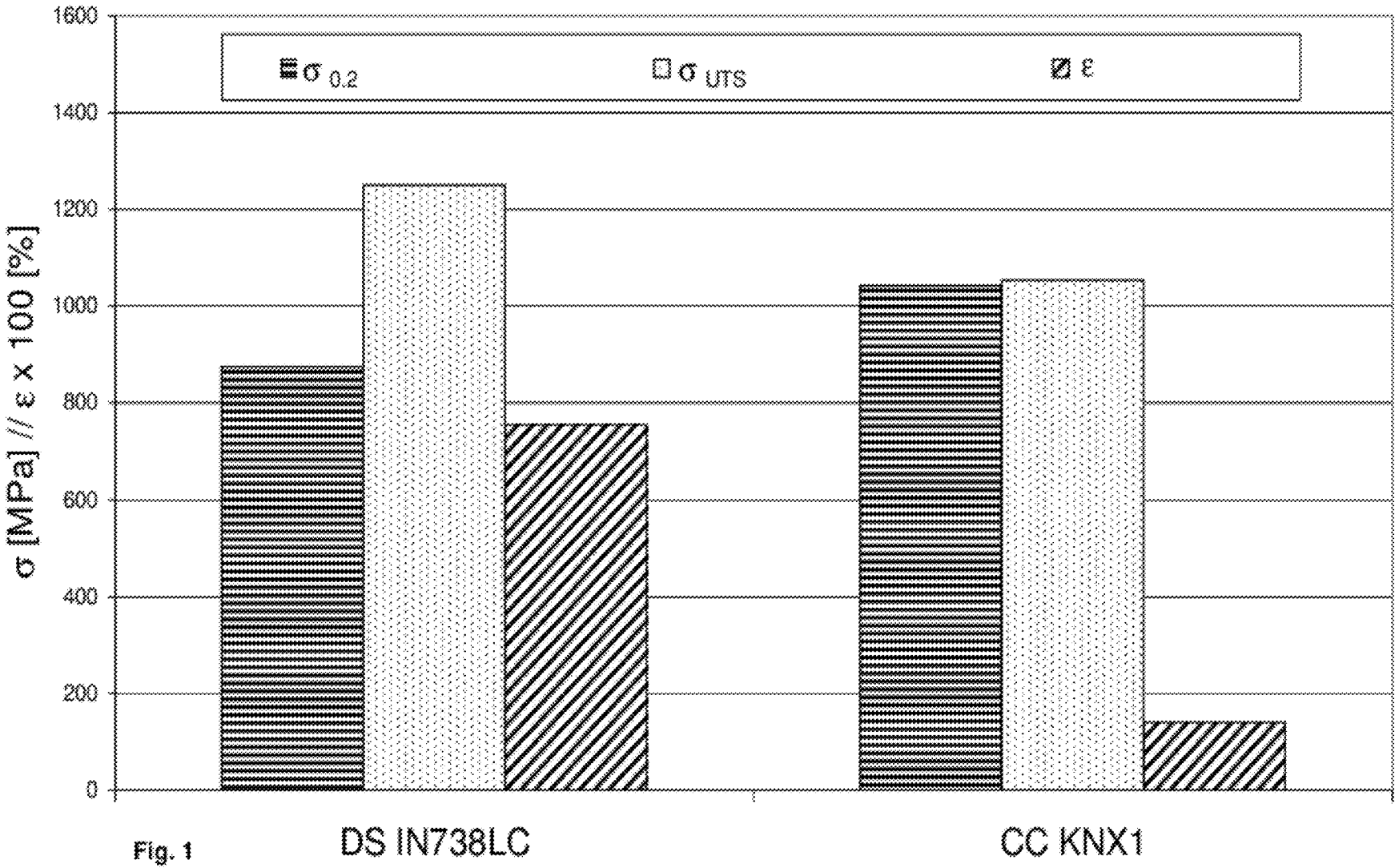
FIG. 1 shows the results of tensile tests (yield strength, tensile strength, elongation) at room temperature for a comparative alloy known from the prior art and an alloy as described herein.

FIG. 1 shows the results of tensile tests (yield strength, tensile strength, elongation) at room temperature for an alloy known from the prior art (DS IN738LC) and the alloy CC KNX1. The respective chemical composition of the alloys is given in table 1.

Before the tensile strength samples were produced, the material was subjected to the following heat treatment:

$$IN738LC:\ \underset{\text{fan cooling }(GFC)}{\underset{2\text{ h}}{1120^\circ\text{ C.}}} + \underset{\text{air cooling}}{\underset{24\text{ h}}{845^\circ\text{ C.}}}. \quad (1)$$

$$KNX1:\ \underset{\text{air cooling}}{\underset{2.5\text{ h}}{1260^\circ\text{ C.}}} + \underset{\text{air cooling}}{\underset{5\text{ h}}{1080^\circ\text{ C.}}} + \underset{\text{air cooling}}{\underset{16\text{ h}}{870^\circ\text{ C.}}}. \quad (2)$$

It can readily be seen in FIG. 1 that the alloy KNX1 which was investigated (conventionally cast) has a significantly increased yield strength $\sigma_{0.2}$ compared to the known (directionally solidified) IN738LC. The tensile strength $\sigma_{UTS}$ and the elongation at break E are lower than in the case of the comparative alloy, however, but this is of hardly any consequence in light of the intended use (gas turbine components).

FIG. 2 depicts a quasi-isothermal oxidation diagram. The change in specific mass $\Delta m/A$ (details in mg/cm$^2$) at a temperature of T=950° C. and a time t in the range of 0 to 720 h is shown for each of the alloys DS IN738LC and CC KNX1. When the two curves are compared, it is clear that the alloy CC KNX1 is superior throughout the range investigated. Above an aging time of about 5 h and longer, the change in mass of the investigated sample made from the alloy according to principles of the present invention is only about 60% of the change in weight of the investigated sample made from the comparative alloy.

Figure 3:
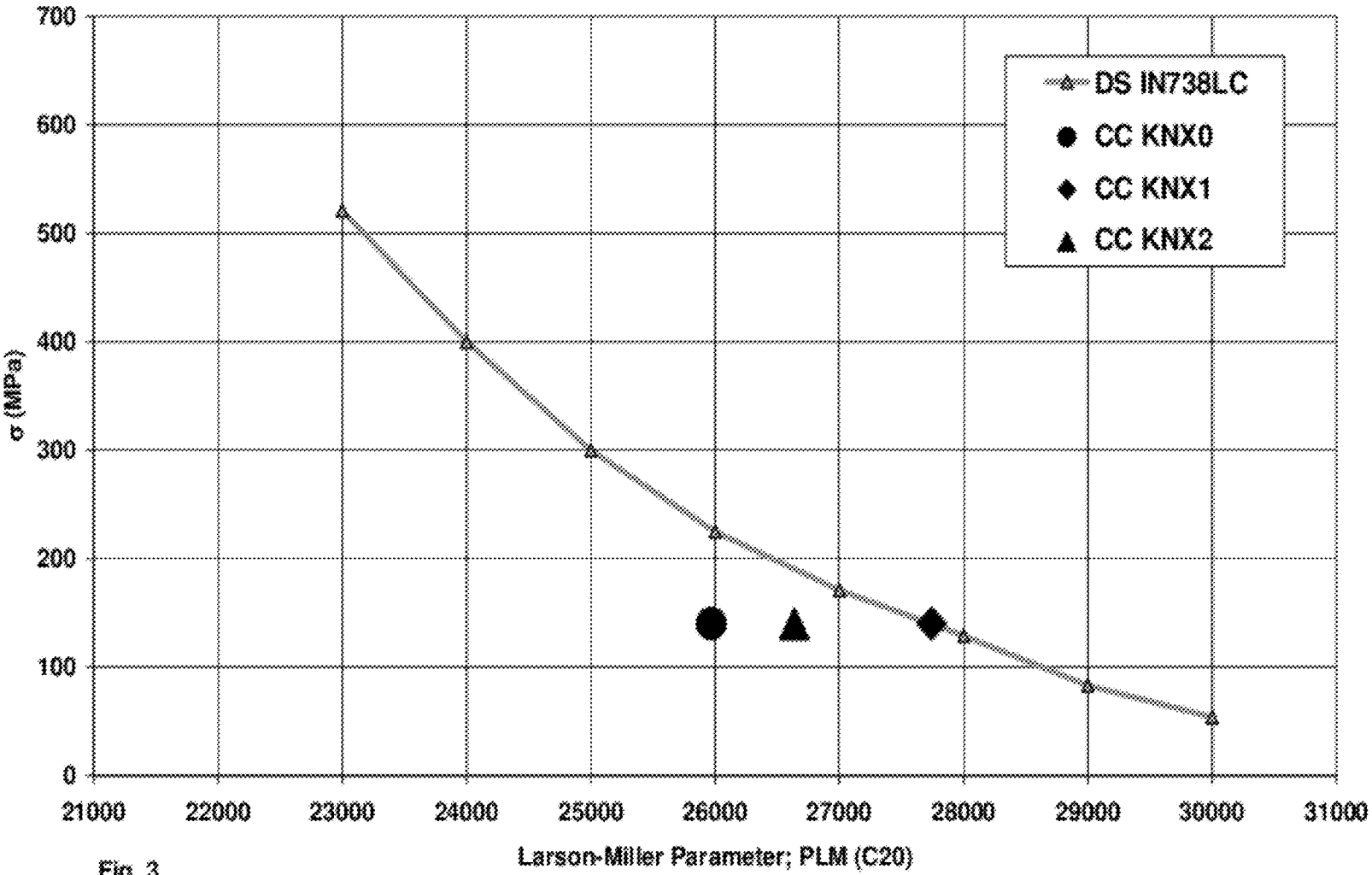
FIG. 3 shows the dependence of the creep strength on the Larson-Miller parameter for the same alloys as in FIG. 1.

FIG. 3 firstly shows the dependence of the creep strength on the Larson-Miller parameter for the same alloys as in FIGS. 1 and 2. Here, the values of these two investigated alloys can be assigned to a single curve, i.e., they are comparable. However, if it is borne in mind that, on account of their microstructure formation, DS (or SX) alloys usually have an improved creep strength compared to conventional, non-directionally solidified multi-crystal microstructures made from alloys with a comparable chemical composition, significantly improved creep properties are to be expected for alloys according to principles of the present invention with DS or SX microstructures.

It is also clear from FIG. 3 that the creep strength at high temperatures is improved enormously with the alloy CC KNX2 compared to the known comparative alloy CC KNX0. It has been determined that, given a load of T=950° C. and $\sigma$=140 MPa, the comparative alloy CC KNX0 fractured after only 17.2 hours, whereas the alloy CC KNX2 withstood the load for more than 3.5 times longer. Since the chemical composition of these two alloys differs substantially only in the Re content (the CC KNX2 contains 1.5% by weight Re, whereas CC KNX0 contains no Re), this can be attributed predominantly to the beneficial influence of this element in the relatively moderate quantity given.

It goes without saying that the invention is not restricted to the exemplary embodiments described.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A nickel-base superalloy, having the following chemical composition (in % by weight):

7.7-8.3 Cr
5.0-5.25 Co
2.0-2.1 Mo
7.8-8.3 W
5.8-6.1 Ta
4.9-5.1 Al
1.0-1.5 Ti
1.0-2.0 Re
0.1-0.2 Nb
0.11-0.15 Si
0.1-0.7 Hf
0.02-0.17 C
50-400 ppm B
remainder nickel and production-related impurities.

2. The nickel-base superalloy as claimed in claim 1, wherein the Re content is 1.0-1.5% by weight.

3. The nickel-base superalloy as claimed in claim 1, wherein the Re content is 1.5% by weight.

4. The nickel-base superalloy as claimed in claim 1, wherein the Nb content is 0.1% by weight.

5. The nickel-base superalloy as claimed in claim 1, wherein the Hf content is 0.1-0.6% by weight.

6. The nickel-base superalloy as claimed in claim 1, wherein the Hf content is 0.1% by weight.

7. The nickel-base superalloy as claimed in claim 1, wherein the C content is 0.02-0.095 by weight.

8. The nickel-base superalloy as claimed in claim 1, wherein the C content is 0.02-0.03% by weight.

9. The nickel-base superalloy as claimed in claim 1, wherein the B content is 50-100 ppm.

10. The nickel-base superalloy as claimed in claim 1, wherein the B content is 90 ppm.

11. The nickel-base superalloy as claimed in claim 1, having the following chemical composition (in % by weight):

8.2 Cr
5.2 Co
2.1 Mo
8.1 W
6.1 Ta
5.0 Al
1.4 Ti
1.5 Re
0.1-0.2 Nb
0.12 Si
0.1-0.6 Hf
0.095-0.17 C
240-290 ppm B
remainder nickel and production-related impurities.

12. The nickel-base superalloy as claimed in claim 1, having the following chemical composition (in % by weight):

8.2 Cr
5.2 Co
2.1 Mo
8.1 W
6.1 Ta
5.0 Al
1.4 Ti
1.5 Re
0.1 Nb
0.12 Si
0.1 Hf
200 ppm C
90 ppm B
reminder nickel and production-related impurities.

13. A nickel-base superalloy, having the following chemical composition (in % by weight):

8.2 Cr
5.2 Co
2.1 Mo
8.1 W
6.1 Ta
5.0 Al
1.4 Ti
1.5 Re
0-0.2 Nb
0.12 Si
0.1-0.6 Hf
0.095-0.17 C
240-290 ppm B
remainder nickel and production-related impurities.

* * * * *